US007810195B2

(12) United States Patent
Biggie et al.

(10) Patent No.: US 7,810,195 B2
(45) Date of Patent: Oct. 12, 2010

(54) APPARATUS AND METHOD FOR RAPIDLY DEFLATING AIR CELLS WITH CHECK VALVES FOR CARDIO PULMONARY RESUSCITATION

(75) Inventors: Lydia B. Biggie, Lighthouse Point, FL (US); Timothy Perez, Coral Springs, FL (US); David M. Genaro, North Lauderdale, FL (US)

(73) Assignee: Anodyne Medical Device, Inc., Los Angeles, CA (US)

( * ) Notice: Subject to any disclaimer, the term of this patent is extended or adjusted under 35 U.S.C. 154(b) by 0 days.

(21) Appl. No.: 11/955,899

(22) Filed: Dec. 13, 2007

(65) Prior Publication Data

US 2008/0148483 A1 Jun. 26, 2008

Related U.S. Application Data

(60) Provisional application No. 60/869,902, filed on Dec. 13, 2006.

(51) Int. Cl.
*A47C 27/10* (2006.01)

(52) U.S. Cl. ..... 5/710; 5/655.3; 5/706; 5/713

(58) Field of Classification Search ..... 5/710, 5/713, 724, 715, 644, 654, 655.3, 706
See application file for complete search history.

(56) References Cited

U.S. PATENT DOCUMENTS

| | | | | | |
|---|---|---|---|---|---|
| 4,638,519 | A * | 1/1987 | Hess | 5/713 |
| 4,935,968 | A * | 6/1990 | Hunt et al. | 5/713 |
| 5,103,519 | A * | 4/1992 | Hasty | 5/715 |
| 5,647,079 | A * | 7/1997 | Hakamiun et al. | 5/713 |
| 6,061,855 | A * | 5/2000 | Flick | 5/713 |
| 6,119,292 | A | 9/2000 | Haas | |
| 6,135,721 | A * | 10/2000 | Hasbrouck | 417/120 |
| 7,263,734 | B1 * | 9/2007 | Buchanan et al. | 5/713 |
| 2003/0208847 | A1 * | 11/2003 | Vrzalik et al. | 5/713 |

* cited by examiner

*Primary Examiner*—Robert G Santos
*Assistant Examiner*—Nicholas Polito
(74) *Attorney, Agent, or Firm*—Nixon & Vanderhye P.C.

(57) ABSTRACT

A support surface includes a plurality of support surface air cells arranged in an array; and a CPR air cell in fluid communication with the support surface air cells via a plurality of inlet ports. The CPR air cell includes at least one outlet port. The outlet port has a higher flow rate than the inlet ports. The use of the CPR air cell provides an economical and efficient mechanism for rapidly deflating an inflatable support surface in the event that CPR is required.

12 Claims, 4 Drawing Sheets

APPARATUS AND METHOD FOR RAPIDLY DEFLATING AIR CELLS WITH CHECK VALVES FOR CARDIO PULMONARY RESUSCITATION

CROSS-REFERENCES TO RELATED APPLICATIONS

This application claims the benefit of U.S. Provisional Patent Application Ser. No. 60/869,902, filed Dec. 13, 2006, the entire content of which is herein incorporated by reference.

STATEMENT REGARDING FEDERALLY SPONSORED RESEARCH OR DEVELOPMENT (Not applicable)

BACKGROUND OF THE INVENTION

The present invention relates to patient support surfaces. In particular, it relates to an inflatable patient support surface that has rapid deflation capability to provide a hard surface when a patient requires cardio pulmonary resuscitation (CPR).

Inflatable support surfaces are commonly used to care for patients in hospitals or other medical environments. A support surface is a mattress made up of air (and/or foam) which is soft and which moves or changes shape with patient movement. An advantage provided by an inflatable support surface is that it provides a substantial amount of comfort for the patient and distributes pressure across wider areas of the patient's body than may be possible using rigid support surfaces.

Unfortunately, while inflatable support surfaces provide a number of benefits to the patient and the medical staff, during the course of its normal use, there are times when an inflatable support surface may have detrimental consequences for the patient.

One such situation arises when an individual is using an inflatable support surface for one type of treatment and is suddenly threatened by cardiac failure or other physical problems that may require the use of CPR. In the situation where CPR is required, the caregiver needs a firm surface for the patient to lie on to adequately perform the CPR procedure. By nature, a support surface is soft and easily deformable. If a patient resting on an inflatable support surface receives CPR, the soft nature of the support surface may prevent the caregiver from resuscitating the individual because pressure placed on the individual's chest will merely push the patient down into the soft support surface. As a result, inflatable support surfaces need to be rapidly deflated in case an emergency CPR needs to be performed on a patient. Excessive amounts of time taken to deflate an inflatable support surface may actually contribute to the death or permanent injury of an individual by delaying the use of CPR. Therefore, it is desirable to deflate the inflatable support surface as quickly as possible so the patient is, in effect, lying on the firm bed frame.

The invention solves this problem by allowing the caregiver to rapidly deflate the soft inflatable support surface such that the patient is supported by the rigid support structure under the inflatable support surface. The placement of the patient on the rigid support surface or bed frame allows the caregiver to effectively perform CPR. More important, by rapidly deflating the support surface, CPR can be administered as quickly as possible without the time delays associated with prior art deflation mechanisms and prior art inflatable support surfaces.

Many prior art support surfaces are deflated by simply releasing the hoses that are attached to the air source, and letting the air in the support surface leak out. In an emergency situation, this method usually takes too long as the whole support surface must deflate through a few small diameter hoses. The hoses are limited in diameter as they cannot be too bulky and therefore disturb the patient.

Other support surfaces use a pump to pull the air out. If the support surface uses a diaphragm type pump, deflation of the support surface will again be too slow. Alternatively, if the air pump is a centrifugal pump, it will have a higher volume of airflow and deflate more quickly than a diaphragm pump. If the electricity fails, however, neither pump will work. The described embodiments provide an air evacuation method that is quicker than prior art methods and does not rely on the availability of electrical power.

BRIEF SUMMARY OF THE INVENTION

The described embodiments provide a CPR air cell connected to a support surface, which rapidly deflates to provide a flat surface for the administration of CPR. The CPR air cell has multiple check valves such as flexible duckbill check valves or the like. The check valves are in the interior of the CPR air cell and use bulkhead fittings attached to the wall of the CPR air cell to connect each valve to exterior hoses from the support surface. The CPR air cell has at least one port to rapidly release air from the cell. When this port is opened, the air can flow from the support surface through the check valves into the CPR air cell and out the port or ports. When the ports are closed, the check valves prohibit the air from escaping from the support surface.

In an exemplary embodiment, a support surface includes a plurality of support surface air cells arranged in an array; and a CPR air cell in fluid communication with the support surface air cells via a plurality of inlet ports. The CPR air cell includes at least one outlet port. The outlet port has a higher flow rate than the inlet ports. In one arrangement, the support surface air cells are divided into zones, each of the zones including at least one support surface air cell, and each of the zones being connected to the CPR air cell via a hose connected to a respective one of the inlet ports. In this context, the support surface may additionally include a plurality of check valves respectively secured over the inlet ports and acting between the zones of the support surface air cells and the CPR air cell. The check valves open and close an airflow path from the zones to the CPR air cell based on a pressure in the CPR cell.

The support surface may additionally include a removable cap securable on the outlet port of the CPR air cell. In this context, the CPR air cell may include two (or more) outlet ports, where the support surface includes two removable caps securable on the outlet ports, respectively. A pull tag may be attached to both of the removable caps to facilitate removal of the removable caps. In another arrangement, the removable cap is securable to the outlet port between the CPR air cell and an interior of the support surface, where the support surface further includes a pull tag connected to the removable cap and disposed outside of the support surface.

The support surface may include a pump connected to the plurality of support surface air cells, where the pump is configured to turn off when the outlet port of the CPR air cell is opened. In this context, the support surface may also include a pressure sensor coupled with the CPR air cell that senses a pressure in the CPR air cell. The pressure sensor communicates with the pump to turn the pump off when a pressure in the CPR air cell drops below a predetermined pressure.

In another exemplary embodiment, a CPR air cell is connectable to an inflatable support surface including a plurality of support surface air cells arranged in an array. The CPR air cell includes a plurality of inlet ports and at least one outlet port. The CPR air cell is connectable in fluid communication with the support surface air cells via the plurality of inlet ports. The at least one outlet port has a higher flow rate than the inlet ports. The inlet ports may be high hat ports welded through a wall of the CPR air cell. The CPR air cell may additionally include a check valve secured to each of the inlet ports that acts between the CPR air cell and the support surface air cells of the inflatable support surface. In this context, the check valves may be duck bill check valves.

In yet another exemplary embodiment, a method of rapidly deflating the inflatable support surface includes the steps of fluidly connecting the plurality of support surface air cells to the CPR air cell via the inlet ports; and opening the at least one outlet port on the CPR air cell, thereby allowing air in the support surface air cells to flow into the CPR air cell and out of the at least one outlet port.

BRIEF DESCRIPTION OF THE DRAWINGS

These and other aspects and advantages will be described in detail with reference to the accompanying drawings, in which.

DETAILED DESCRIPTION OF THE INVENTION

Figure 4:
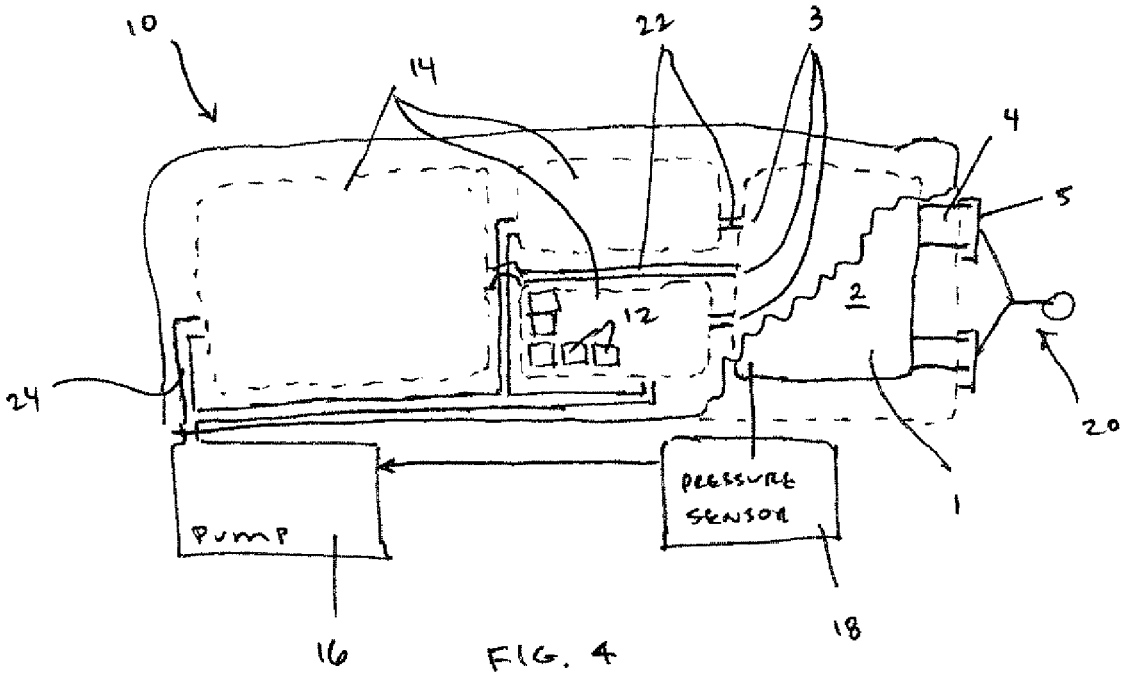
FIG. 4 is a partial cutaway plan view of a support surface including the CPR air cell.

A general overview of the system will be presented with reference to FIG. 4. A preferred embodiment provides a CPR air cell 1 that has input ports 3 connected to air cells 12 arranged in zone arrays or zones 14 in the support surface 10. The CPR air cell 1 also has at least one output port 4 to rapidly release air from the CPR air cell 1 when needed. In this embodiment, a pump 16, which provides pressurized air to the air cells 12, is turned off when the CPR air cell 1 is opened or activated. This is accomplished by sensing the pressure at the CPR air cell 1 by a pressure sensor 18. If there is a sudden drop in pressure in the CPR air cell 1 caused by the output ports 4 being opened, the pressure sensor 18 communicates with the pump 16 to automatically turn the pump 16 off. It is undesirable to have the pump 16 filling the support surface 10 when the CPR air cell mechanism is deflating the support surface 10.

The CPR air cell 1 has at least one port 4 that vents the air inside the cell to the outside. In the preferred embodiment, the CPR air cell 1 has a generally cylindrical structure with a port 4 at both ends, and is placed at the head of the support surface 10. When CPR is needed, a cap 5 which seals the port 4, is pulled open via a pull tag 20 or the like. These ports 4 are large so a high volume of air can escape in seconds. Those skilled in the art will recognize that the shape of the CPR air cell 1, the number of input lines 3, the number of output ports 4, and the placement of the CPR air cell 1 in relation to the support surface 10 can vary. For example, it can be placed at the foot, or even the side of the support surface.

The support surface 10 has a number of zones 14. Each zone is comprised of one or more support surface air cells 12 that are connected together. Each zone 14 on the support surface 10 is connected to the CPR air cell via a hose 22 that outputs air from the zone 14 to the CPR air cell 1. The more zones 14 the support surface 10 has, the more connections to the CPR cell 1, and the larger the area for air to vent, which results in rapid support surface deflation. However, in the preferred embodiment, the hoses 22 that connect the zones 14 to the CPR air cell 1 are different than the hoses 24 that connect the support surface 10 to the air pump 16. The CPR air cell 1 is preferably located at the head of the support surface 10. The close proximity to the zones 14 allows the use of short, but large diameter hoses 22 that run from the zones 14 to the CPR air cell 1. These large diameter hoses 22 are not bulky and are positioned such that they do not disturb the patient lying on the bed.

The hoses 22 from each of the zones 14 attach to fittings, such as barbed or quick disconnect fittings. These fittings are attached to the CPR air cell by a protruding "high hat" type of port that is welded through the wall of the CPR air cell 1. In the preferred embodiment, a check valve 26, such as a duckbill check valve, is secured over the opening of this high hat port.

Figure 3A:
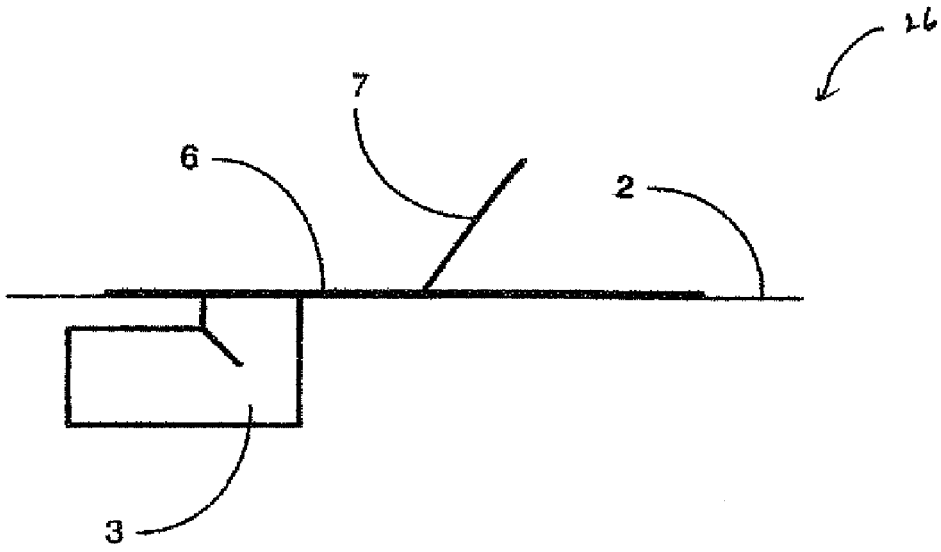
FIGS. 3A-3C show views of an exemplary duckbill check valve.
Figure 3B:
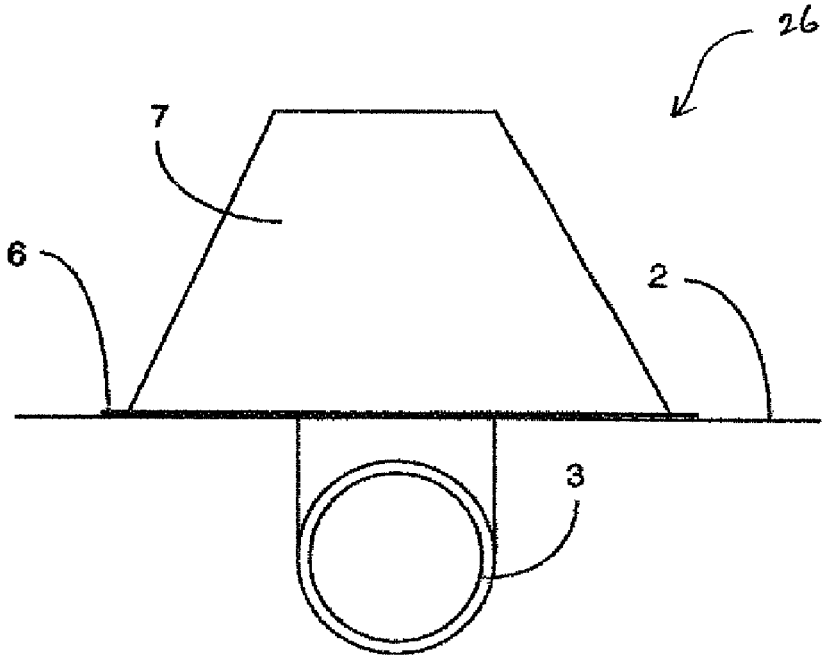
Figure 3C:
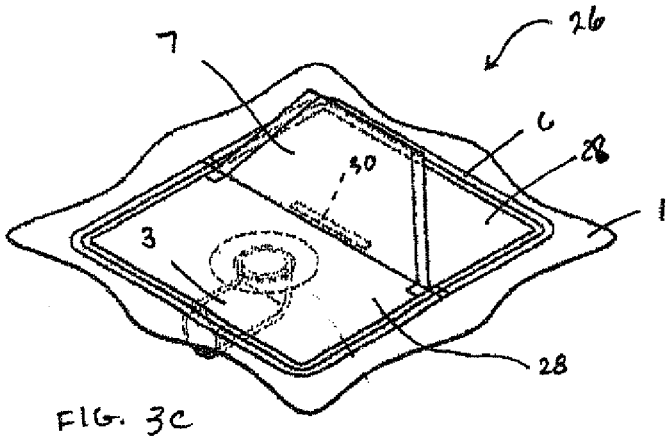

An exemplary design of the check valve 26 is unique to this application. FIG. 3A is a side view of a preferred embodiment of a duckbill check valve 26, FIG. 3B is an end view thereof, and FIG. 3C is a perspective view thereof. With reference to FIGS. 3A-3C, the check valve 26 includes a flat sheet 6 of flexible urethane or vinyl or similar air tight material. The sheet is welded to the wall of the CPR air cell 1, but over the high hat port. The check valve 26 keeps air in the CPR air cell 1. To this sheet 6 are attached two half sheets 28 such that the outside perimeter of the bottom sheet is sealed by the two half sheets 28, but the half sheet forms a middle vertical wall 7 over the bottom sheet. The middle wall 7 has a side that can be at an angle. The end is open and allows air to enter into the CPR air cell 1. There is a short weld 30 at the base of the vertical wall 7 that fastens the half sheets 28 and bottom sheet 6 to the wall of the air cell 1. The last weld and the slanted sides of the vertical wall increase airflow and prevent noise from duckbill vibrations.

Although the duckbill check valves is shown, any typically available off the shelf check valves would work just as well as an alternative. These check valves have a barbed end that would attach to the bulkhead fittings on the exterior of the CPR air cell 1. The other end of the check valve attaches to the hoses of the mattress. The off the shelf valves can be obtained with various cracking pressures and various barbed fitting sizes.

The check valve acts between the air cell zones 14 and the CPR air cell 1 such that when there is a greater air pressure inside the CPR air cell 1 than in the support surface zones 14, the soft flexible material on the check valve 26 closes the opening port of the high hat fitting. When the air pressure inside the CPR air cell 1 is released by removing the cap(s) 5, the air pressure in the CPR air cell 1 is lower than the air pressure in the support surface zones 14, and the check valve 26 opens and allows air to flow from the support surface 10, through the check valves 26, into the CPR air cell 1, and out the large CPR output ports 4 at the ends of the CPR air cell.

Figure 1:
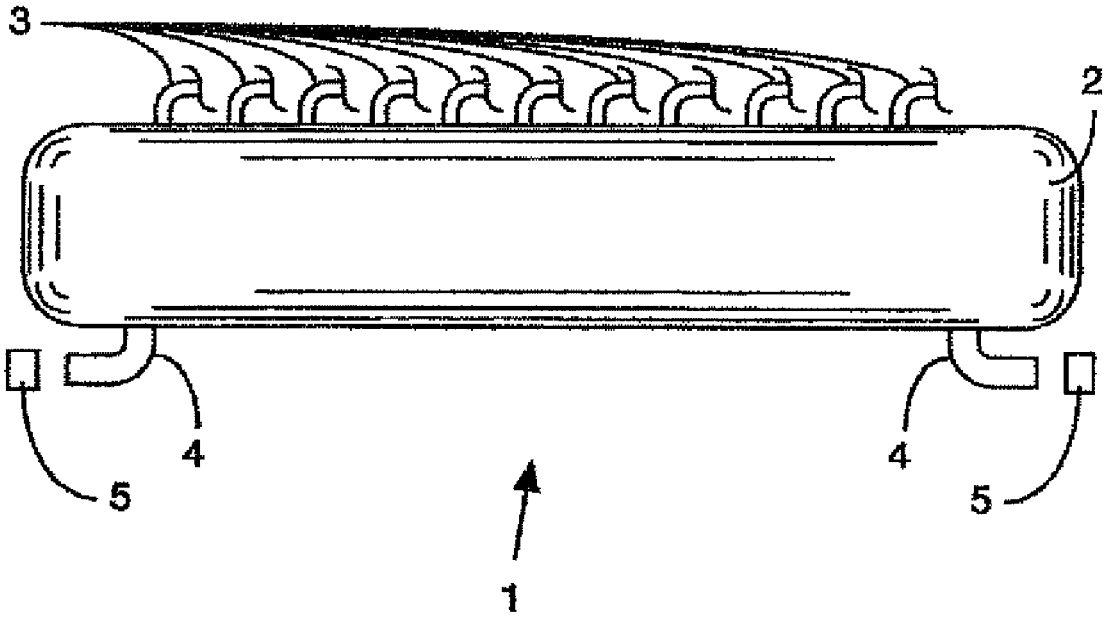
FIG. 1 is a side view of a preferred embodiment of a CPR air cell.

FIG. 1 is a side view of a preferred embodiment of the CPR air cell 1. The CPR air cell 1 has an inflatable body 2 that is inflated by air input through input hoses 3. Each input hose 3 is attached to a zone 14 of a support surface 10 (shown in FIG.

4). When the air pressure from the support surface zones 14 equals the air pressure inside the CPR air cell 1, the check valves 26 (e.g., duckbill check valves shown in FIGS. 3A-3C) closes. Air ceases to flow into the CPR air cell 1, and the support surface 10 remains inflated. If the patient requires CPR, one or more caps 5 are detached from the output ports 4, and air is released from the CPR air cell 1. There are several suitable designs for the caps 5 that allow the output ports 4 to be opened to rapidly release air. These caps 5 can be a simple plug that fits into the output ports 4 on the CPR cell 1. A pull tag or line 20 may be attached to the caps 5 and extends to the exterior of the support surface mattress 10 for ease of removal from the ports 4. Alternatively, the caps 5 may be part of a mechanism that is placed between the CPR air cell 1 and the outer cover of the support surface 10. This makes the caps 5 readily available from the exterior of the mattress. The mechanism may have several components including two rings attached to the exterior and interior of the mattress wall, the cap plug with pull tag that fits inside the ring, and a connection from the interior ring to the output port 4 of the CPR cell 1. There would be at least one cap 5, but preferable two, one at each end of the CPR cell 1.

When the caps 5 are removed, the drop in pressure allows air to exit the support surface zones 14 and enter the CPR air cell 1, where it is exhausted via output ports 4. In addition, the pressure sensor 18 detects the drop in pressure in the CPR air cell 1 and shuts off the air pump 16, which would normally maintain air pressure in the support surface 10. This allows the support surface to rapidly deflate.

By rapidly deflating the support surface in this manner, a patient can be quickly placed in contact with the rigid surface under the support surface. This allows a patient to receive CPR with a minimum amount of delay.

Figure 2:
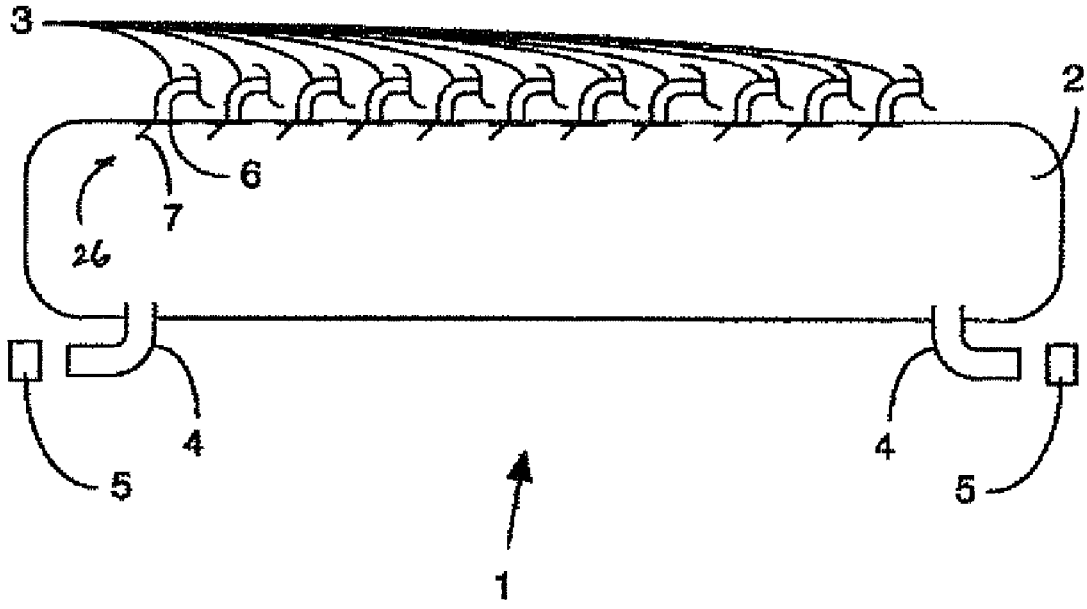
FIG. 2 is a side cutaway view of a preferred embodiment of a CPR air cell.

FIG. 2 is a side cutaway view of a preferred embodiment of a CPR air cell 1. FIG. 2 illustrates duckbill check valves 26 welded to the inside of inflatable body 2.

The use of the CPR air cell provides an economical and efficient mechanism for rapidly deflating an inflatable support surface in the event that CPR is required. Check valves acting between the support surface zones and the CPR air cell serve to ensure that pressure is maintained in the zones when desired and that rapid deflation can be effected when necessary.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims. For example, the material used to construct the CPR air valve may be anything suitable for its purpose, and the size, shape and location of the CPR air valve can vary. The type and number of input hoses and output ports may also be varied, etc.

The invention claimed is:

1. A support surface comprising: a plurality of support surface air cells arranged in an array, the support surface air cells including inlet hoses connectable to a source of pressurized air located fore of the support surface air cells; and a CPR air cell located aft of the support surface air cells defining a space for containing air under pressure in fluid communication with the support surface air cells via connecting hoses coupled with a plurality of inlet ports, wherein the connecting hoses are different from the inlet hoses, the CPR air cell including at least one outlet port, wherein the at least one outlet port has a higher flow rate than the inlet ports, and wherein the CPR air cell is interposed between the outlet port and the support surface air cells such that venting of the CPR air cell effects venting of the support surface air cells.

2. A support surface according to claim 1, wherein the support surface air cells are divided into zones, each of the zones including at least one support surface air cell, and each of the zones being connected to the CPR air cell via a corresponding one of the connecting hoses connected to a respective one of the inlet ports.

3. A support surface according to claim 2, further comprising a plurality of check valves respectively secured over the inlet ports and acting between the zones of the support surface air cells and the CPR air cell, wherein the check valves open and close an airflow path from the zones to the CPR air cell based on a pressure in the CPR air cell.

4. A support surface comprising:

a plurality of support surface air cells arranged in an array;

a CPR air cell defining a space for containing air under pressure in fluid communication with the support surface air cells via a plurality of inlet ports, the CPR air cell including at least one outlet port, wherein the at least one outlet port has a higher flow rate than the inlet ports, and wherein the CPR air cell is interposed between the outlet port and the support surface air cells such that venting of the CPR air cell effects venting of the support surface air cells; and a plurality of check valves acting between the support surface air cells and the CPR air cell, wherein the check valves open and close an airflow path from the support surface air cells to the CPR air cell based on a pressure in the CPR air cell such that when the pressure in the CPR air cell drops by virtue of the CPR air cell being opened, the check valves open to vent the support surface air cells with the CPR air cell.

5. A support surface according to claim 1, further comprising a removable cap securable on the outlet port of the CPR air cell.

6. A support surface according to claim 5, wherein the CPR air cell comprises two outlet ports, and wherein the support surface comprises two removable caps securable on the outlet ports, respectively.

7. A support surface according to claim 6, further comprising a pull tag attached to both of the removable caps, the pull tag facilitating removal of the removable caps.

8. A support surface according to claim 5, wherein the removable cap is securable to the outlet port between the CPR air cell and an interior of the support surface, the support surface further comprising a pull tag connected to the removable cap and disposed outside of the support surface.

9. A support surface according to claim 1, further comprising a pump as the source of pressurized air connected to the plurality of support surface air cells, wherein the pump is configured to turn off when the outlet port of the CPR air cell is opened.

10. A support surface according to claim 9, further comprising a pressure sensor coupled with the CPR air cell, the pressure sensor sensing a pressure in the CPR air cell, the pressure sensor communicating with the pump to turn the pump off when a pressure in the CPR air cell drops below a predetermined pressure.

11. A method of rapidly deflating an inflatable support surface including a plurality of support surface air cells arranged in an array and a CPR air cell located aft of the support surface air cells defining a space for containing air under pressure and including a plurality of inlet ports and at least one outlet port, wherein the at least one outlet port has a higher flow rate than the inlet ports, and wherein the support surface air cells are connectable to a source of pressurized located fore of the support surface air cells air via inlet hoses, the method comprising: interposing the CPR air cell between the outlet port and the support surface air cells; fluidly connecting the plurality of support surface air cells to the CPR air cell via connecting hoses, different from the inlet hoses, coupled with the inlet ports; and opening the at least one outlet port on the CPR air cell, thereby allowing air in the support surface air cells to flow into the CPR air cell and out of the at least one outlet port such that venting of the CPR air cell effects venting of the support surface air cells.

12. A method according to claim 11, further comprising interposing a plurality of check valves between the support surface air cells and the CPR air cell, and configuring the check valves to open and vent the support surface air cells when a pressure in the CPR air cell drops by virtue of being opened.

* * * * *